US006263643B1

(12) United States Patent
Kovacs et al.

(10) Patent No.: US 6,263,643 B1
(45) Date of Patent: Jul. 24, 2001

(54) ELASTICATED NETTING

(75) Inventors: Zoli Kovacs, Ellistown; Stuart Baird Revill, Swadlincote, both of (GB)

(73) Assignee: Trunature Ltd, Swadlincote (GB)

( * ) Notice: Subject to any disclaimer, the term of this patent is extended or adjusted under 35 U.S.C. 154(b) by 0 days.

(21) Appl. No.: 09/295,909

(22) Filed: Apr. 21, 1999

(30) Foreign Application Priority Data

May 2, 1998 (GB) ..... 9809487
Jan. 20, 1999 (GB) ..... 9901079

(51) Int. Cl.[7] ..... B65B 9/00

(52) U.S. Cl. ..... 53/459; 53/567; 53/575; 53/576; 53/577

(58) Field of Search ..... 53/459, 567, 574, 53/575, 576, 577, 585

(56) References Cited

U.S. PATENT DOCUMENTS 3,412,523 * 11/1968 Raymond et al. .
3,529,401 * 9/1970 Sartore et al. .
3,657,861 * 4/1972 Soodalter .
3,745,611 * 7/1973 Patouillard .
3,805,480 4/1974 Cherio et al. .
3,858,365 * 1/1975 Fernandez .
3,868,895 * 3/1975 Hart et al. .

FOREIGN PATENT DOCUMENTS 1 949 862 12/1970 (DE) .
2 162 805 7/1973 (FR) .
2 232 951 1/1991 (GB) .
6-048403 * 2/1994 (JP) .

* cited by examiner

*Primary Examiner*—S. Thomas Hughes
*Assistant Examiner*—Eric Compton
(74) *Attorney, Agent, or Firm*—Akerman Senterfitt

(57) ABSTRACT

A machine for automatically loading tubes with elasticated netting in a folded condition comprises an array of fingers which, by reciprocative movement of the tube relatively through the array, will draw off a continuous sleeve of the netting from a spreader device and store it on the tube. Thereafter the fingers and spreader device are raised and the fingers splayed from the tube, enabling the sleeve of netting to be cut above the tube, after which the loaded tube can be removed and replaced by an unloaded one.

12 Claims, 2 Drawing Sheets

ELASTICATED NETTING

BACKGROUND OF THE INVENTION

This invention relates to elasticated netting, and more particularly to the automation of the procedure of loading tubes with the netting in a folded condition.

SUMMARY OF THE INVENTION

Elasticated netting is produced as a continuous sleeve which, in its unstressed condition, is only a few centimetres wide. It is used to enclose products such as joints of meat, being expanded to surround a product so that when released it lightly grips the product, the cut-off ends of the sleeve folding themselves around the ends of the product. Elasticated netting thus holds together a body which might otherwise tend to fall apart, such as a joint of meat during cooking, as well as assisting in such processes as the curing of ham.

The commonest way to locate netting around products is first of all to store the netting in a folded condition on a tube the inner diameter of which is large enough for the products to be netted to pass down it. This tube is of course of considerably greater diameter than the unstressed sleeve of netting. A means is employed to grip the netting and then move it from one end to the other of the tube so that the netting folds on the tube like a badly rucked sock. When no more netting can be stored on the tube the sleeve is cut behind the tube and the tube can then be taken away for use in enclosing products. In this way, of course, the length of netting stored on a tube is a multiple of the length of the tube. Products are passed through the tube and as they emerge they draw off enough of the stored netting to enclose them, whereupon the sleeve is cut behind each product.

An example of such a gripping means takes the form of an annular array of fingers surrounding the tube. The fingers are lightly spring-loaded so that their tips will touch the tube, extending therefrom at an acute angle. When the tube is reciprocated axially of the array of fingers the fingers will, on an upstroke of the tube, engage holes in the net and drag it toward the opposite end of the tube. On an downstroke of the tube the fingers will ride over the net. Thus the net is progressively folded along the length of the tube.

The use of the equipment of the immediately preceding paragraph is labour intensive and time consuming. First an operator must take a tube and expand the sleeve around one end of it. He must then pass the tube through the array of fingers until it locates accurately on a platform. Once the tube is loaded with netting he must remove it from the finger array and cut off the sleeve behind the tube.

A principal object of the present invention is to improve upon the above procedure by speeding it up and automating it, thus reducing both labour costs and the down time which currently occurs while awaiting the loaded tubes.

In accordance with one aspect of the present invention there is provided apparatus for the automated loading of elasticated netting in a folded condition onto storage tubes, the apparatus comprising a work station, means for supplying the netting in the form of a continuous sleeve in an unstressed condition toward the work station, means for delivering the storage tubes in sequence to the work station, spreader means for expanding a leading end of the sleeve to a diameter equal to or greater than that of a tube at the work station, said spreader means being displaceable along an axis generally perpendicular to the work station, finger means arranged about said axis, each finger being movable between an operative position in which it may contact a tube at the work station and an inoperative position displaced laterally from said tube, and means for relatively reciprocatively displacing a tube at the work station and said finger means generally along said axis with the finger means in said operative position such that repeated, reciprocative relative movement of the tube and finger means will store in a folded condition on the tube netting introduced to the tube by the spreader means and engaged by the finger means, the finger means being subsequently displaceable to the inoperative position and movable with the spreader means along said axis away from the work station to allow the sleeve to be cut near to the loaded tube and to permit removal of the latter from the work station and its replacement by an unloaded tube.

Preferably the spreader means comprises a shaft portion and a head portion of greater diameter than the shaft portion, the head portion tapering to the shaft portion over a generally frusto conical surface, the diameter of the shaft portion being such that in use the sleeve may pass along it generally in an unstressed condition and means being provided to grasp the shaft portion around the sleeve for purposes of holding the spreader means in an elevated position when a loaded tube is to be removed from the work station.

The finger means preferably comprises an annular array of pivotally mounted fingers spring loaded to extend inwardly of the array and a control ring relatively movable axially of the array and disposed to abut the fingers to displace the same from the operative to the inoperative position when the array of fingers is moved away from the work station.

The head portion preferably has cut-away regions around a cylindrical portion of its length to facilitate engagement of the fingers with netting passed around said cylindrical portion.

Means is preferably provided for holding the spreader means and the finger means in an intermediate position in which the spreader means is in proximity to an upper end of an upright tube at the work station and the finger means is in an operative position with the fingers thereof in contact with the spreader means, the spreader means and finger means are preferably jointly displaceable upwardly from said intermediate position to a raised position in which the finger means is in the inoperative position and the spreader means is above said tube upper end and means is preferably provided for relatively reciprocating the finger means and the workstation along said axis while the spreader means and finger means are in said intermediate position so that the finger means moves relatively along said tube to draw netting over the spreader means and fold it upon said tube.

The finger means may be mounted below a first plate the position of which relative to a second plate is controlled by first ram means and second ram means may be provided for reciprocating the second plate along said axis relative to the work station while a predetermined relationship is maintained between the first and second plates by the first ram means.

Abutment means may be provided on the second plate to arrest upward movement of the control ring as the finger means is raised from the lowered to the raised position by the first ram means, thereby causing abutment of the control ring with the fingers and displacement of the latter to the inoperative position.

Means may be provided for reciprocating the work station toward and away from the finger means.

Conveyor means may be disposed laterally of the work station to convey unloaded tubes in an upright position in sequence to a position laterally alongside the work station and pusher means may be provided operable transversely of the conveyor means to push a leading one of the unloaded tubes onto the work station thereby simultaneously displacing a loaded tube from the work station.

Gripper means may be located to engage between them a rectangular base flange of an upright tube positioned on the workstation, said gripper means being actuable to grip the flange when the tube is so located and to release the flange when the tube is to be displaced off the workstation.

Cutter means is preferably provided operable to cut the sleeve from a loaded tube at the work station when the finger means and spreader means are moved away from the loaded tube, the cutter means being movable through the space vacated by the finger means.

A dolly may be removably locatable on the upper end of a said tube at the workstation, said dolly and the spreader means having male and female formations which will engage in the lowered position of the spreader means to assure coaxial alignment between the spreader means and said tube, said dolly serving also to space the head of the spreader means from said upper end of the tube to prevent nipping of the sleeve therebetween.

In accordance with another aspect of the present invention there is provided a method of loading elasticated netting in a folded condition onto storage tubes utilising the apparatus of the twelve immediately preceding paragraphs, the method comprising locating a leading end of a continuous sleeve of netting on the spreader means with the latter and the finger means in a raised position above the work station, bringing the tubes in sequence to the work station in an upright position so that a tube at the work station is generally coaxially aligned with the spreader means, lowering the spreader means into proximity with the upper end of said tube at the work station, lowering the finger means and bringing the latter to the operative position so that the fingers engage the netting around the spreader means, relatively reciprocating said tube at the work station and said finger means whereby the latter folds netting upon said tube, moving said finger means to the inoperative position, raising the finger means and spreader means above said upper end of the tube, cutting the sleeve above the loaded tube and removing the loaded tube laterally from the work station and locating an unloaded tube at the work station.

The method may comprise simultaneously displacing both the finger means and the workstation toward and away from one another.

Unloaded tubes may be carried to the work station by conveyor means disposed laterally of the work station and pusher means moving transversely of the conveyor may be employed to move a leading one of the tubes on the conveyor from the conveyor onto the work station, said leading tube serving simultaneously to displace a loaded tube from the work station.

BRIEF DESCRIPTION OF THE DRAWINGS

A preferred embodiment of the invention will now be described with reference to the accompanying diagrammatic drawings, in which.

DETAILED DESCRIPTION OF THE PREFERRED EMBODIMENTS

Figure 1:
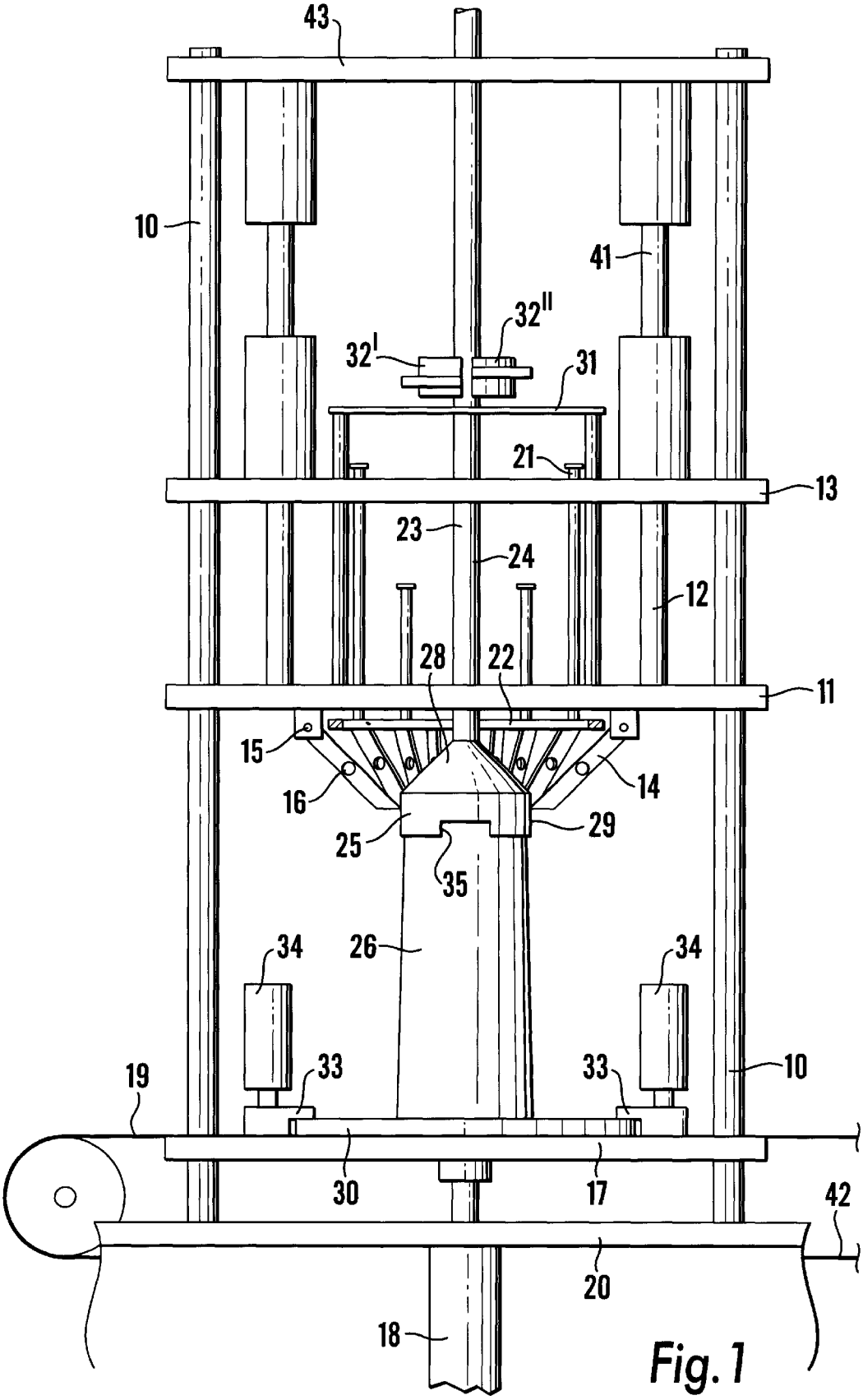
FIG. 1 is an elevational view of apparatus in accordance with the invention, partially broken away.

The apparatus illustrated in FIG. 1 comprises columns 10 extending between a base 42 of the machine and a fixed top plate 43. They serve to guide plates 17, 11 and 13 as the latter are displaced vertically by respective pneumatic rams as will be described. Rams 12 are fixed to plate 13 and can reciprocate plate 11 relative to plate 13. Rams 41 are fixed to immovable top plate 43 and can reciprocate plate 13 and therefore rams 12 and plate 11 bodily with plate 13.

Figure 2:
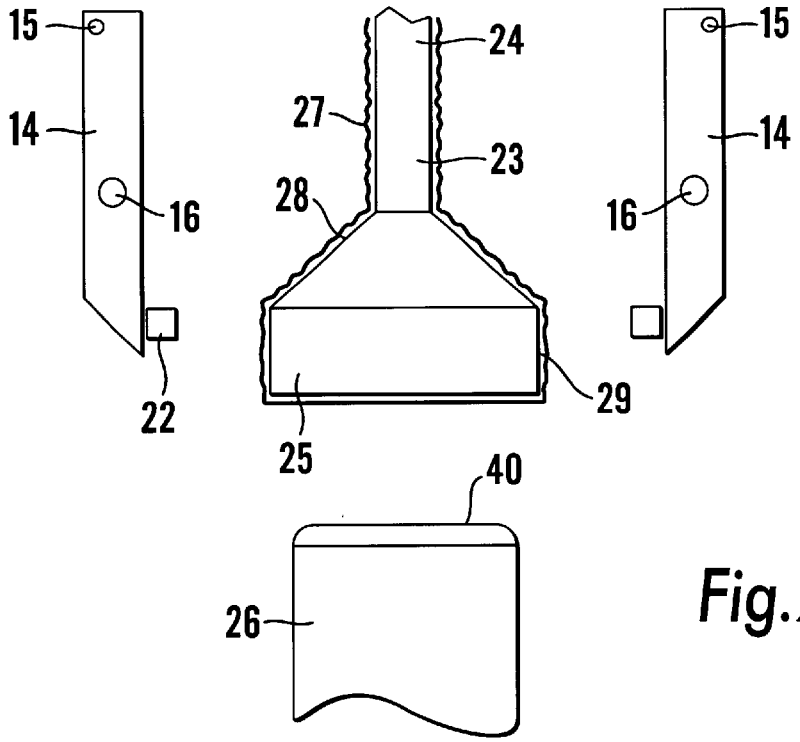
FIGS. 2 and 3 are similar, detailed views on an enlarged scale illustrating components of the apparatus of FIG. 1 in different phases of operation.
Figure 3:
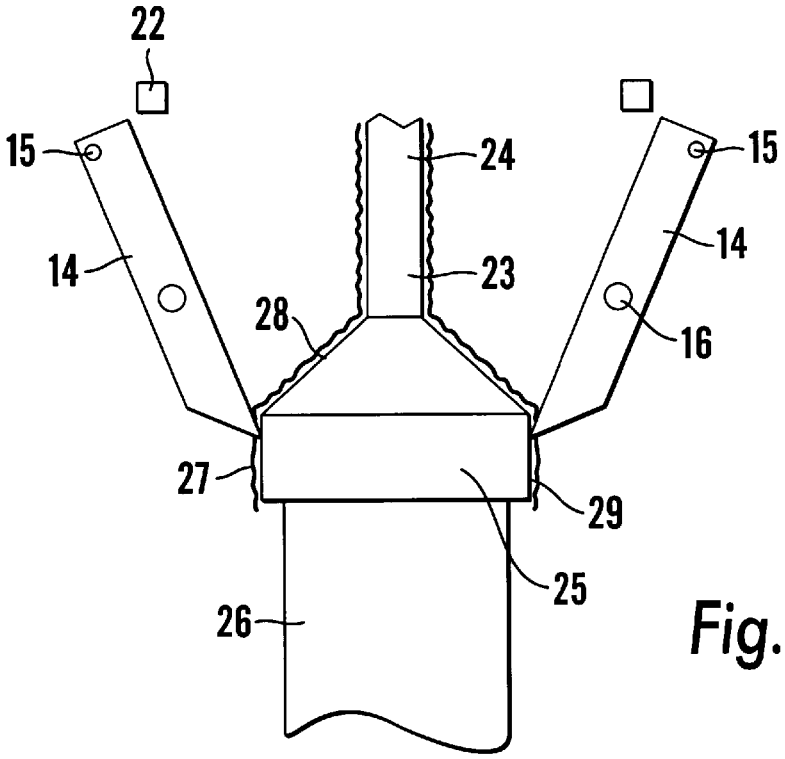

Beneath plate 11 and extending downwardly therefrom is an annular array of fingers 14 each having a respective pivotal connection at 15 to plate 11 so as to be displaceable between the generally vertical position shown in FIG. 2 and the inwardly and downwardly directed position shown in FIG. 3. The fingers 14 are collectively biassed toward the latter position by an annular coil spring (not shown) which engages each finger at 16.

The array of fingers 14 is coaxially aligned vertically with a further pneumatic ram 18 which carries at its top end plate 17. The plate 17 serves as a work station.

A conveyor 19 delivers tubes 26 in sequence to a position alongside plate 17. Each tube 26 has a rectangular bottom flange 30 which holds it upright and abutment of the flanges 30 of adjacent tubes while on the conveyor 19 serves to maintain them in a correctly spaced apart relationship.

At the commencement of operations the plate 17 is in the lowered position shown in FIG. 1 and plate 13 is held by rams 41 in the raised position shown in FIG. 1. By retraction of rams 12 relative to plate 13 plate 11 is also in a raised position represented by FIG. 2. As plate 11 moves to the fully raised position the tops of rods 21 extending upward from a control ring 22 encounter a plate 31 which has a fixed position relative to plate 13. This arrests the control ring 22 and as plate 11 continues upward ring 22 encounters the fingers 14 and displaces them from the position of FIG. 3 to the position of FIG. 2.

The shaft 23 of a spreader device 24 has at its lower end an enlarged head 25. The diameter of this head portion 25 is slightly greater than that of a tube 26 standing on the work station plate 17. The diameter of the shaft 23 is on the other hand slightly less than that of a sleeve 27 of elasticated netting in the unstressed condition of the latter. Before commencing to operate the machine illustrated the leading end of a continuous sleeve 27 of the netting is passed along shaft 24 and over a frusto conical shoulder 28 between shaft 24 and head 25, thus expanding the netting until it is stretched over a cylindrical surface 29 of head 25.

Prior to lifting plate 11 arcuate clamping elements 32', 32" move oppositely to grip shaft 23 between them so that the spreader device will rise with plate 11.

It is now possible for pusher means (not shown) operating transversely of the conveyor 19 to push a leading one of the tubes 26 from the conveyor onto the plate 17. As the tube moves onto the plate its flange 30 locates under L-shaped lugs 33 movable vertically by respective pneumatic rams 34. When the tube 26 loaded onto plate 17 is coaxial with shaft 23 of the spreader device rams 34 are actuated to cause lugs 33 to clamp the flange 30 of the tube in position on the workstation plate 17.

Plate 11 is now lowered relative to plate 13 and clamps 32', 32" released so that the head 25 of the spreader device is located on a dolly 40 (FIG. 2) loosely located on top of tube 26 at the workstation. The dolly 40 preferably has a central aperture (not shown) in which a spigot (not shown) projecting from the spreader device 24 will locate when lowered, thus holding the spreader device 24 in coaxial alignment with the tube 26. The purpose of dolly 40 is also to prevent the netting 25 becoming nipped between head 25 and the top of the tube 26. The tips of fingers 14 are now in contact with surface 29 and therefore engage the leading end of the netting sleeve 27 which is expanded over head 25. To ensure such engagement the periphery of the head 25 is cut away at circumferentially spaced positions as at 35 to ensure that at least some finger tips pass through the netting to engage weft threads when the fingers 14 thereafter move downward.

Clamping elements 32',32" now move apart so that the spreader device 24, resting on top of tube 26 at the workstation, can rise therewith. The plate 17 is now reciprocated vertically by the ram 18 and simultaneously the plate 13 is reciprocated vertically by the rams 41. These movements are synchronised so that the plate 11 together with the fingers 14 descends as the plate 17 rises, and vice versa so that the netting sleeve 27 is dragged over spreader head 25 and onto the tube 26 as the latter rises through the descending array of fingers 14. As is known per se the fingers engage the netting only when plates 11 and 17 are moving toward one-another and ride over it as the plates 11 and 17 move apart, causing the expanded netting to fold around the tube 26. The stroke of reciprocation of rams 41 and 18 incrementally reduces as the tube 26 becomes loaded with netting. This can be achieved by reversing the valves controlling the operation of rams 41 and 18 whenever resistance to the upstroke is encountered caused by the netting already folded onto tube 26. The operation as a whole is preferably controlled by a timer.

Once the tube 26 at the workstation is fully loaded plate 17 is arrested in the lowered position of FIG. 1 and plate 13 is arrested in the raised position of FIG. 1. Plate 11 is now raised by rams 12 relative to plate 13 so that the netting sleeve is exposed between the top of tube 26 and spreader head 25, enabling cutter means (not shown) to move in horizontally between columns 10 and cut the sleeve close to spreader head 25.

Rams 34 are now actuated to cause lugs 33 to release flange 30 of the loaded tube and the pusher means is actuated to move a fresh, unloaded tube onto the workstation plate 17 from conveyor 19. In so doing it pushes the loaded tube 26 off plate 17 and onto a table 20 on the opposite side of the workstation to the conveyor 19. There is a step down from the plate 17 to the table 20 which causes the loaded tube 26 to topple, thus ensuring that its base flange 30 is fully separated from that of the newly positioned tube 26.

With a fresh, unloaded tube 26 in position on workstation plate 17 the whole process is repeated.

It will be understood that the simultaneous movement of plates 13 and 17 toward and away from one another to fold the netting onto a tube 26 is not essential. Either of the plates 13 and 17 might be stationary, only the other moving, but the simultaneous movement of both plates effectively halves the time taken to load a tube with netting.

By means of the machine of the invention tubes loaded with folded elasticated netting may be supplied continuously and automatically to the table 20, where they are available for use when required.

We claim:

1. An apparatus for the automated loading of elasticated netting in a folded condition onto storage tubes, the apparatus comprising:

a work station;

means for supplying the netting in the form of a continuous sleeve in an unstressed condition toward the work station;

means for delivering the storage tubes in sequence to the work station;

spreader means for expanding a leading end of the sleeve to a diameter equal to or greater than that of a tub at the work station, said spreader means displaceable along an axis generally perpendicular to the work station;

finger means arranged about said axis having at least one finger, wherein each finger is movable between an operative position in which it may contact a tube at the work station and an inoperative position displaced laterally from said tube;

means for relatively reciprocatively displacing a tube at the work station and said finger means generally along said axis with the finger means in said operative position such that repeated, reciprocative relative movement of the tube and finger means will store in a folded condition on the tube netting introduced to the tube by the spreader means and engaged by the finger means, the finger means being subsequently displaceable to the inoperative position and movable with the spreader means along said axis away from the work station to allow the sleeve to be cut near to the loaded tube and to permit removal of the latter from the work station and its replacement by an unloaded tube;

means for holding the spreader means and the finger means in an intermediate position, in which the spreader means is in proximity to an upper end of an upright tube at the work station and the finger means is in an operative position with the fingers thereof in contact with the spreader means, wherein the spreader means and the finger means are jointly displaceable upwardly from said intermediate position to a raised position in which the finger means is in the inoperative position and the spreader means is above said tube upper end and wherein means is provided for relatively reciprocating the finger means and the workstation along said axis while the spreader means and finger means are in said intermediate position so that the finger means moves relatively along said tube to draw netting over the spreader means and fold it upon said tube; and wherein the finger means is mounted below a first plate the position of which relative to a second plate is controlled by first ram means and wherein second ram means is provided for reciprocating the second plate along said axis relative to the work station while a predetermined relationship is maintained between the first and second plates by the first ram means.

2. The apparatus of claim 1, wherein the spreader means comprises a shaft portion and a head portion of greater distance than the shaft portion, the head portion tapering to the shaft portion over a generally frusto-conical surface, the diameter of the shaft portion being such that in use the sleeve may pass along it generally in an unstressed condition and means being provided to grasp the shaft portion around the sleeve for purposes of holding the spreader means in an elevated position when a loaded tube is to be removed from the work station.

3. The apparatus of claim 2, wherein the finger means comprises an annular array of pivotally mounted fingers spread loaded to extend inwardly of the array and a control ring relatively movable axially of the array and disposed to abut the fingers to displace the same from the operative to the inoperative position when the array of fingers is moved away from the work station.

4. The apparatus of claim 3, wherein the head portion has cut-away regions around a cylindrical portion of its length to facilitate engagement of the fingers with netting passed around said cylindrical portion.

5. The apparatus of claim 2, wherein abutment means is provided on the second plate to arrest upward movement of a control ring as the finger means is raised from the lowered to the raised position by the first ram means, thereby causing abutment of the control ring with the fingers and displacement of the latter to the inoperative position.

6. The apparatus of claim 1, further comprising means for reciprocating the work station toward and away from the finger means.

7. The apparatus of claim 1, further comprising conveyor means disposed laterally of the work station to convey unloaded tubes in an upright position in sequence to a position laterally alongside the work station and pusher means operable transversely of the conveyor means to push a leading one of the unloaded tubes onto the work station thereby simultaneously displacing a loaded tube from the work station.

8. The apparatus of claim 7, further comprising gripper means located to engage between them a rectangular base flange of an upright tube positioned on the workstation, said gripper means being actuable to grip the flange when the tube is so located and to release the flange when the tube is to be displaced off the workstation.

9. The apparatus of claim 1, further comprising cutter means operable to cut the sleeve from a loaded tube at the work station when the finger means and spreader means are moved away from the loaded tube, the cutter means being movable through the space vacated by the finger means.

10. The apparatus of claim 1, further comprising a dolly removably locatable on the upper end of a said tube at the workstation, said dolly and the spreader means having male and female formations which will engage in the lowered position of the spreader means to assure coaxial alignment between the spreader means and said tube, said dolly serving also to space the head of the spreader means from said upper end of the tube to prevent nipping of the sleeve therebetween.

11. A method of loading elasticated netting in a folded condition onto storage tubes utilizing an apparatus having a work station, means for supplying the netting in the form of a continuous sleeve in an unstressed condition toward the work station, means for delivering the storage tubes in sequence to the work station, spreader means for expanding a leading end of the sleeve to a diameter equal to or greater than that of a tub at the work station, wherein said spreader means is displaceable along an axis generally perpendicular to the work station, finger means arranged about said axis having at least one finger, wherein each finger is movable between an operative position in which it may contact a tube at the work station and an inoperative position displaced laterally from said tube, and means for relatively reciprocatively displacing a tube at the work station and said finger means generally along said axis with the finger means in said operative position such that repeated, reciprocative relative movement of the tube and finger means will store in a folded condition on the tube netting introduced to the tube by the spreader means and engaged by the finger means, the finger means being subsequently displaceable to the inoperative position and movable with the spreader means along said axis away from the work station to allow the sleeve to be cut near to the loaded tube and to permit removal of the latter from the work station and its replacement by an unloaded tube, the method comprising the steps of:

locating a leading end of a continuous sleeve of netting on the spreader means with the latter and the finger means in a raised position above the work station;

bringing the tubes in sequence to the work station in an upright position so that a tube at the work station is generally coaxially aligned with the spreader means;

lowering the spreader means into proximity with the upper end of said tube at the work station, lowering the finger means and bringing the latter to the operative position so that the fingers engage the netting around the spreader means;

relatively reciprocating said tube at the work station and said finger means, whereby the latter folds netting upon said tube;

moving said finger means to the inoperative position;

raising the finger means and spreader means above said upper end of the tube;

cutting the sleeve above the loaded tube and removing the loaded tube laterally from the work station;

locating an unloaded tube at the work station;

carrying unloaded tubes to the work station by conveyor means disposed laterally of the work station;

moving a leading one of the tubes on the conveyor from the conveyor onto the work station using a pusher means moving transversely of the conveyor, said leading tube serving simultaneously to displace a loaded tube from the work station.

12. The method of claim 11, further comprising the step of simultaneously displacing both the finger means and the workstation toward and away from one another.

* * * * *